US007832499B2

(12) United States Patent
Komuro et al.

(10) Patent No.: US 7,832,499 B2
(45) Date of Patent: Nov. 16, 2010

(54) ELECTRIC TOOL WITH CLOSABLE AIR PORTS

(75) Inventors: Yoshihiro Komuro, Ibaraki (JP); Katsuhiro Oomori, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 142 days.

(21) Appl. No.: 12/132,601

(22) Filed: Jun. 3, 2008

(65) Prior Publication Data

US 2008/0302551 A1 Dec. 11, 2008

(30) Foreign Application Priority Data

Jun. 5, 2007 (JP) ..... P2007-148847

(51) Int. Cl.
*E21B 3/00* (2006.01)

(52) U.S. Cl. ..... 173/217; 173/171

(58) Field of Classification Search ..... 173/217, 173/171, 168, 169

See application file for complete search history.

(56) References Cited

U.S. PATENT DOCUMENTS

| | | | | |
|---|---|---|---|---|
| 2,155,082 | A * | 4/1939 | Galloway | 173/217 |
| 5,317,224 | A * | 5/1994 | Ragaly | 310/58 |
| 5,419,737 | A * | 5/1995 | Brazell et al. | 451/453 |
| 5,526,777 | A * | 6/1996 | Taomo et al. | 123/41.65 |
| 5,591,070 | A * | 1/1997 | Kachich | 451/295 |
| 6,043,575 | A * | 3/2000 | Ghode et al. | 310/52 |
| 6,779,612 | B2 * | 8/2004 | Nishikawa et al. | 173/217 |
| 6,827,157 | B2 * | 12/2004 | Fuchs | 173/217 |
| 7,094,011 | B2 * | 8/2006 | Kopras et al. | 409/137 |
| 2004/0027010 | A1 * | 2/2004 | Oomori et al. | 310/50 |
| 2005/0252670 | A1 * | 11/2005 | Prell et al. | 173/39 |
| 2005/0257942 | A1 * | 11/2005 | Chang | 173/104 |
| 2008/0265695 | A1 * | 10/2008 | Yoshida et al. | 310/50 |
| 2009/0145621 | A1 * | 6/2009 | Lau et al. | 173/217 |
| 2009/0218113 | A1 * | 9/2009 | Johnen et al. | 173/20 |

FOREIGN PATENT DOCUMENTS

| | | |
|---|---|---|
| CN | 1419998 | 5/2003 |
| JP | 11333761 | 12/1999 |
| JP | 2003-200364 | 7/2003 |
| JP | 3674308 | 5/2005 |

* cited by examiner

*Primary Examiner*—Brian D Nash
(74) *Attorney, Agent, or Firm*—McDermott Will & Emery LLP

(57) ABSTRACT

An electric tool includes a housing; a motor that is housed in the housing; and a tip tool. A rotation transmission mechanism transmits a rotation of the motor to the tip tool. An air inlet is disposed on the housing to introduce a cooling air for cooling the motor from an outside of the housing and an air outlet is disposed to discharge the cooling air. A cover is slidable along an inner wall or an outer wall of the housing and is movable in a first position where the air inlet and the air outlet are opened and a second position where the air inlet and the air outlet are closed.

3 Claims, 8 Drawing Sheets

ELECTRIC TOOL WITH CLOSABLE AIR PORTS

CROSS-REFERENCE TO RELATED APPLICATIONS

This application is based upon and claims a priority from prior Japanese Patent Application No. 2007-148847 filed on Jun. 5, 2007, the entire contents of which are incorporated herein by reference.

BACKGROUND OF THE INVENTION

1. Field of the Invention

An aspect of the present invention relates to an electric tool having air inlets and air outlets that supply and discharge cooling air for cooling an electric motor serving as a drive source and that are formed in a housing.

2. Description of the Related Art

FIG. 12 shows the configuration of an impact driver as an example of the electric tool.

FIG. 12 is a side cross-sectional view of the impact driver. An illustrated impact driver 1 is a tool that drives a rotary impacting mechanism while taking a battery 2 as a power source and an electric motor 3 as a drive source and imparts rotation and a strike to an anvil 4, to thus intermittently transmit rotary striking force to an unillustrated tip tool and drive a screw into a material to be fastened.

The electric motor 3 is housed in a body 5A of a housing 5, and both ends of an output shaft 6 (a motor spindle) of the motor are supported by ball bearings 7 and 8 in a rotatable manner. A cooling fan 9 is tied to the output shaft 6. A switch 10 that toggles on and off a power supply from the battery 2 to the electric motor 3, to thus activate and deactivate the electric motor 3, is provided in an upper portion of a handle 5B of the housing 5.

In the rotary impacting mechanism built in a hammer case 11, rotation of the output shaft 6 of the electric motor 3 is decelerated by way of a planetary gear mechanism 12 and transmitted to a spindle 13, whereupon the spindle 13 is rotationally driven at a given velocity. The spindle 13 and the hammer 14 are joined together by means of a cam mechanism. The cam mechanism is made up of V-shaped spindle cam grooves 13*a* formed in an outer peripheral surface of the spindle 13; V-shaped hammer cam grooves 14*a* formed in an inner peripheral surface of the hammer 14; and balls 15 engaging with the cam grooves 13*a* and 14*a*.

The hammer 14 is urged toward a tip end (i.e., in a rightward direction in FIG. 12) at all times by means of a spring 16. When remained stationary, the hammer is situated at a position spaced apart from an end face of the anvil 4 by means of engagement of the balls 15 with the cam grooves 13*a* and 14*a*. Unillustrated protuberances are symmetrically formed at two positions on each of mutually-opposing rotational planes of the hammer 14 and the anvil 4.

When the spindle 13 is rotationally driven as mentioned previously, rotation is transmitted to the hammer 14 by way of the cam mechanism. Before the hammer 14 makes half rotation, the protuberances of the hammer 14 engage with the protuberances of the anvil 4, thereby starting rotation of the anvil 4. Because of reaction force resultant from engagement, relative rotation arises between the hammer 14 and the spindle 13, whereupon the hammer 14 starts receding toward the electric motor 3 along the spindle cam groove 13*a* of the cam mechanism while compressing the spring 16.

When the protuberances of the hammer 14 get over the protuberances of the anvil 4 as a result of receding action of the hammer 14, to thus become disengaged from each other, the hammer 14 is moved forwardly by urging force of the spring 16 while being rapidly accelerated in the rotating and forward directions by means of elastic energy accumulated in the spring 16 and action of the cam mechanism as well as rotational force of the spindle 13. The protuberances are again engaged with the protuberances of the anvil 4, to thus initiate rotation in an integrated fashion. At this time, strong rotational striking force is exerted on the anvil 4, and hence rotational striking force is transmitted to the screw by way of a tip tool attached to the anvil 4.

Subsequently, similar operation is iterated, whereby rotational striking force is intermittently, repeatedly transmitted from the tip tool to the screw, whereupon the screw is driven into the material to be fastened, such as lumber.

Incidentally, in such an impact driver 1, air inlets 17 and air outlets 18 that supply and discharge cooling air are formed on either side of the body 5A of the housing 5. Cooling air is drawn into, by suction, the housing 5 by way of the air inlets 17 by means of a cooling fan 9 that rotates along with the output shaft 6 of the electric motor 3. Thus, the cooling air supplied into the housing 5 flows forwardly after passing by the electric motor 3, to thus cool the electric motor 3, and are subsequently discharged outside the housing 5 from the air outlets 18.

A plurality of slit-shaped ribs 17*a* are provided in the air inlet 17 formed in the housing 5, and a plurality of slit-shaped ribs 18*a* are also provided in the air outlets 18 formed in the housing 5. A contrivance is made, by means of the ribs 17*a* and 18*a*, to partition the air inlets 17 and the air outlets 18 into pores, thereby preventing intrusion of extraneous matter into the housing 5.

Although intrusion of extraneous matter, which are greater than the air inlets 17 partitioned into the pores by the ribs 17*a*, into the housing 5 is prevented, extraneous matter that is smaller than the air inlets 17 passes through the air inlets 17, to thus enter the housing 5 and adhere to the ball bearings 7 and 8 supporting the output shaft 6 of the electric motor 3 and induce anomalous rotation in the electric motor 3 as a result of depletion of grease of the ball bearings 7 and 8. Alternatively, extraneous matter is attracted by the magnetic force of a magnet 3*a* of the electric motor 3, to thus enter between an armature core 3*b* and the magnet 3*a* and induce a breakdown, such as deactivation of the electric motor 3. Such a problem easily takes place in a working environment where there is much extraneous matter, such as dust or metal powder.

JP-2003-200364-A describes a technique for closing a portion of an air outlet (an air exit port) by means of a cover in such a way that hot air resultant from cooling of the electric motor does not flow toward a face.

Japanese Patent No. 3674308 describes a technique for attaching a reclosable cover to an air vent; and causing the cover to operate to open the air vent during operation of a tool and close the air vent when the tool is at rest.

However, according to the technique described in connection with JP-2003-200364-A, only the portion of the air outlet (the air exit port) is closed by means of the cover. The air inlet still remains open, and intrusion of extraneous matter from the air inlet into the housing cannot be hindered, so that the problem attributable to intrusion of extraneous matter cannot be solved.

According to the technique described in connection with Japanese Patent No. 3674308, only the air vent is closed while the tool is at rest, and both an air intake and the air vent still remain open when the tool is in operation. Therefore, intrusion of extraneous matter into the housing cannot be hindered, and the problem attributable to intrusion of extraneous matter cannot be solved.

SUMMARY OF THE INVENTION

The present invention has been conceived in view of the problems and aims to provide an electric tool capable of selecting an air intake and exhaust state suitable for a working environment and thoroughly preventing intrusion of extraneous matter into a housing in a working environment with much extraneous matter.

According to an aspect of the present invention, there is provided an electric tool including: a housing; a motor that is housed in the housing; a tip tool; a rotation transmission mechanism that transmits a rotation of the motor to the tip tool; an air inlet that is disposed on the housing to introduce a cooling air for cooling the motor from an outside of the housing; an air outlet that is disposed to discharge the cooling air; and a cover that is slidable along an inner wall or an outer wall of the housing and that is movable in a first position where the air inlet and the air outlet are opened and a second position where the air inlet and the air outlet are closed.

The cover may be linearly slidable with respect to the housing.

The cover may be rotationally slidable with respect to the housing.

According to such a configuration, the cover is moved inside or outside the housing during work performed in an environment with much extraneous matter, to thus be able to simultaneously cover both the air inlets and the air outlets. Hence, intrusion of extraneous matter into the housing can be prevented thoroughly, and occurrence of various problems, such as a failure, which would otherwise be caused by intrusion of extraneous matter, can be prevented. During work performed in a comparatively-clean environment with little extraneous matter, both the air inlets and the air outlets are opened, to thus actively introduce cooling air into the housing and efficiently cool the electric motor by means of the cooling air. Thus, an increase in the temperature of the electric motor can be prevented.

The electric tool may further include a packing that is interposed between the cover and the housing.

According to such a configuration, a sealing characteristic achieved between the cover and the housing is enhanced by the packing. Hence, much superior dustproof of the electric tool is ensured.

According to another aspect of the present invention, there is provided an electric tool including: a housing; a motor that is housed in the housing; a tip tool; a rotation transmission mechanism that transmits a rotation of the motor to the tip tool; an air inlet that is disposed on the housing to introduce a cooling air for cooling the motor from an outside of the housing; an air outlet that is disposed to discharge the cooling air; and a cover that is attachable to the housing to close the air inlet and the air outlet and is detachable from the housing to open the air inlet and the air outlet.

According to such a configuration, intrusion of extraneous matter into the housing can be prevented thoroughly, so long as the cover is attached to the housing during work performed in an environment with much extraneous matter, to thus simultaneously close both the air inlets and the air outlets and prevent occurrence of various problems resultant from intrusion of extraneous matter, such as a failure. Further, so long as the cover is formed from a soft material, the cover can also be caused to act as a protector. In addition, so long as several types of colors and patterns of covers are prepared in advance, covers to be attached to respective electric tools used by individual operators can be readily discerned. During work performed in a comparatively-clean environment with little extraneous matter, both the air inlets and the air outlets are opened without attachment of the cover to the housing, thereby actively introducing cooling air into the housing and efficiently cooling the electric motor by means of the cooling air. Thus, an increase in the temperature of the electric motor can be prevented.

BRIEF DESCRIPTION OF THE DRAWINGS

Embodiments of the present invention will be described in detail based on the following figures, wherein.

DETAILED DESCRIPTION OF THE INVENTION

Embodiments of the present invention will be described hereunder by reference to the accompanying drawings.

First Embodiment

Figure 1:
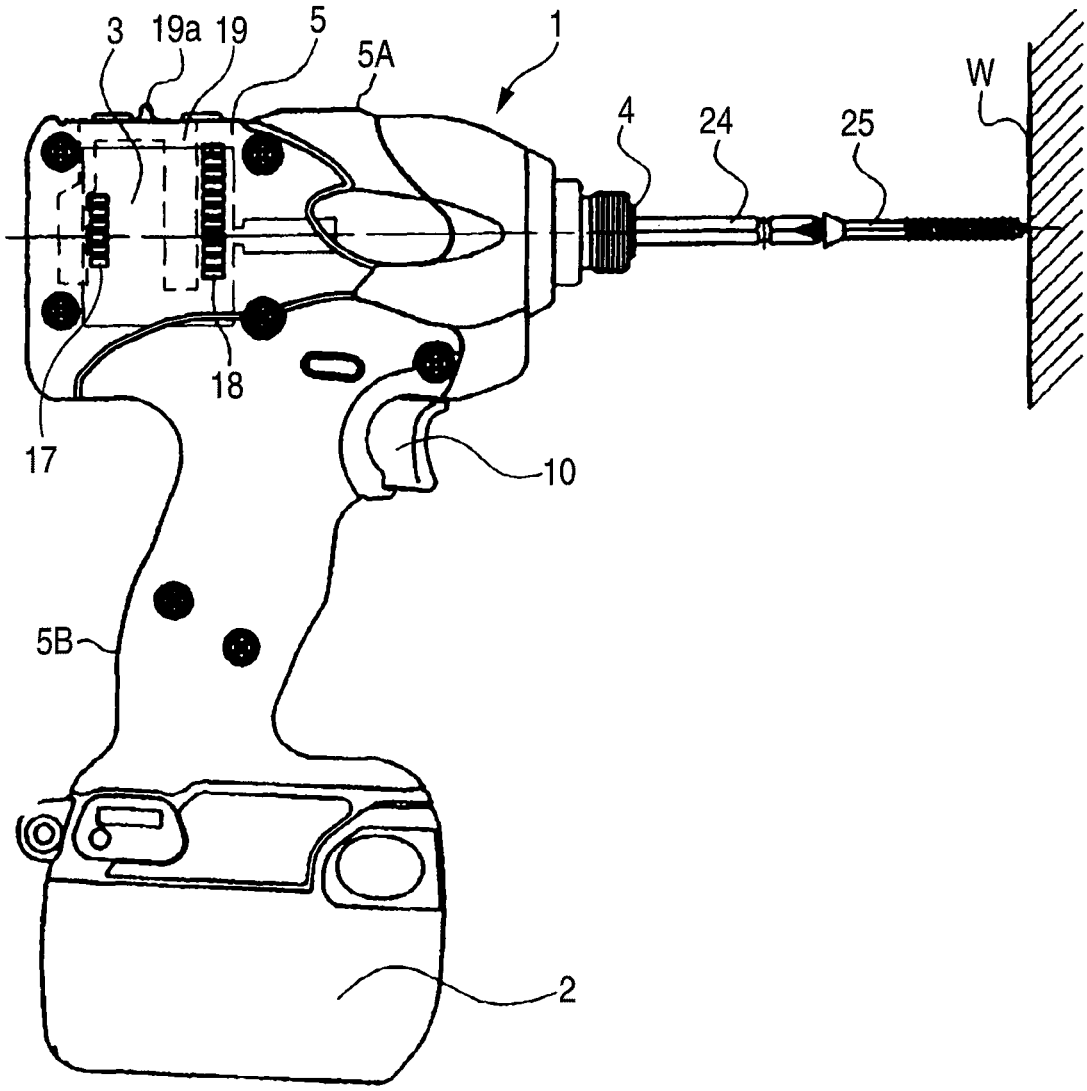
FIG. 1 is a side view of an impact driver according to a first embodiment.
Figure 2:
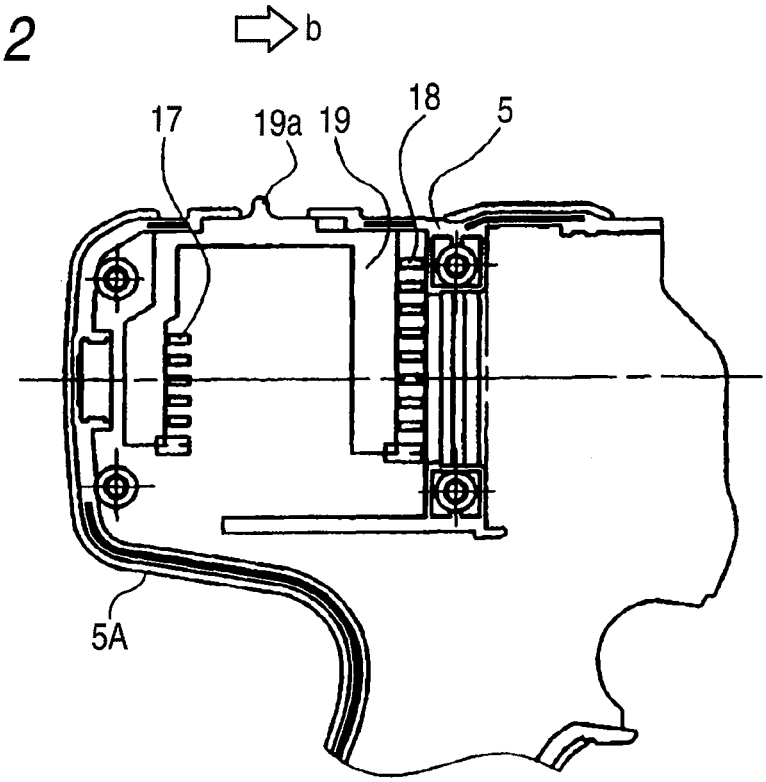
FIG. 2 is a fragmentary internal drawing of a housing when air inlets and air outlets of the impact driver according to the first embodiment are opened.
Figure 3:
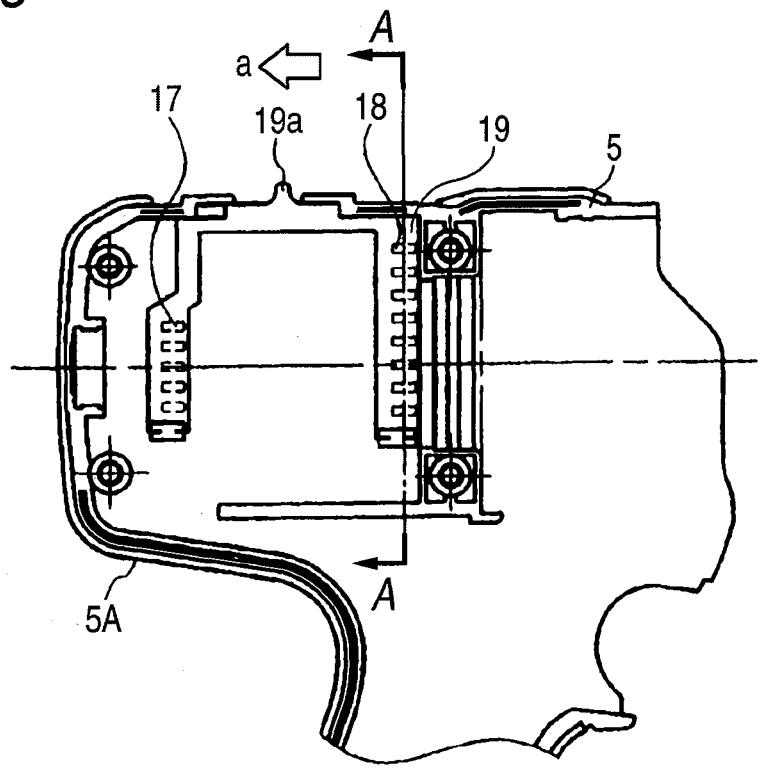
FIG. 3 is a fragmentary internal drawing of the housing when the air inlets and the air outlets of the impact driver according to the first embodiment are closed.

FIG. 1 is a side view of an impact driver that is an embodiment (first embodiment) of an electric tool; FIG. 2 is fragmentary internal drawing of a housing achieved when air inlets and air outlets of the impact driver are opened; FIG. 3 is a fragmentary internal drawing of the housing achieved when the air inlets and the air outlets of the impact driver are closed; and FIG. 4 is a cross-sectional view taken along line A-A shown in FIG. 3.

The impact driver 1 shown in FIG. 1 has a housing 5 that assumes the shape of the letter T when viewed sideways and that is formed from a resin. An electric motor 3 serving as a drive source is housed in a sideways position within a body 5A of the housing 5. A battery 2 is removably attached to a lower end of a handle 5B extending downwardly, in an integrated fashion, from the body 5A of the housing 5. A switch 10 that toggles on or off a power supply from the battery 2 to the electric motor 3, to thus activate/deactivate the electric motor 3, is provided in an upper portion of the handle 5B.

Air inlets 17 and air outlets 18 for supplying or discharging cooling air are formed on either side of the body 5A of the housing 5. Cooling air is drawn into the housing 5, by suction, from the air inlets 17 by means of an unillustrated cooling fan that rotates along with an output shaft of the electric motor 3. Thus, the cooling air supplied into the housing 5 passes by the electric motor 3 and flows forwardly, to thus cool the electric motor 3. Subsequently, the cooling air is discharged outside the housing 5 from the air outlets 18.

Figure 4:
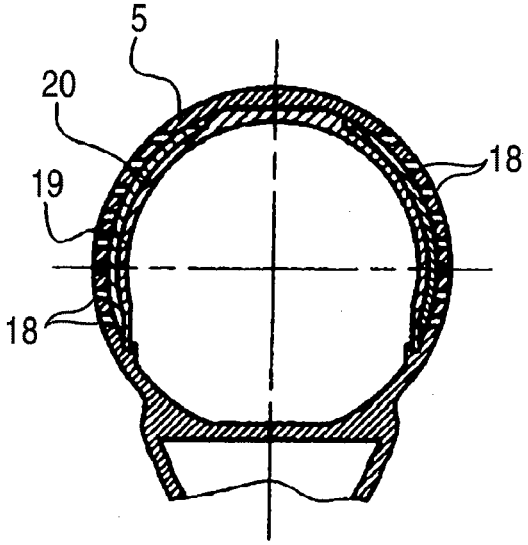
FIG. 4 is a cross-sectional view taken along line A-A shown in FIG. 3.

As shown in FIGS. 2 through 4, in the first embodiment, a cover 19 that slide in a longitudinal direction along the inside of the housing 5, to thus simultaneously open or close the air inlets 17 and the air outlets 18, is provided in the body 5A of the housing 5. As shown in FIGS. 1 through 3, a lever 19*a* for slidably actuating the cover 19 is formed integrally on a part of an upper surface of the cover 19 exposed through the housing 5. As shown in FIG. 4, packing 20 formed from an elastic material, such as silicon rubber, is interposed between the cover 19 and the housing 5.

When screwing operation is performed by use of the impact driver 1 configured as mentioned above, rotational striking force is transmitted to an anvil 4 and a bit 24 that is a tip tool attached to the anvil, so long as the switch 10 is turned on, to thus activate the electric motor 3. Thus, a screw 25 is driven into a material W to be fastened, such as lumber, by means of the bit 24.

Incidentally, in a working environment with much extraneous matter such as dust or metal powder, a lever 19*a* is actuated, to thus slide the cover 19 forwardly along the inside of the housing 5 (in the direction of arrow "a" in FIG. 3), thereby simultaneously closing the air inlets 17 and the air outlets 18 by means of the cover 19 as shown in FIGS. 3 and 4. Thus, intrusion of extraneous matter, such as dust, into the housing 5 is prevented without fail, and occurrence of various problems attributable to intrusion of extraneous matter, such as a failure, is prevented. In particular, in the first embodiment, a sealing characteristic achieved between the cover 19 and the housing 5 is enhanced by the packing 20, so that much enhanced dustproof of the impact driver 1 is ensured.

During work performed in a comparatively-clean environment with little extraneous matter, the lever 19*a* is actuated, to thus slide the cover 19 backwardly (in the direction of arrow "b" in FIG. 2) along the inside of the housing 5, to thus open both the air inlets 17 and the air outlets 18 as shown in FIG. 2. Thus, cooling air is actively introduced into the housing 5 by way of the air inlets 17, and the electric motor 3 is efficiently cooled by the cooling air, so that an increase in the temperature of the electric motor 3 is prevented. The cooling air whose temperature is increased as a result of being used for cooling the electric motor 3 is discharged to the atmosphere by way of the air outlets 18.

Accordingly, according to the first embodiment, an air intake and exhaust state of cooling air suitable for the working environment can be selected.

Second Embodiment

A second embodiment will be described by reference to FIGS. 5 through 7.

Figure 5:
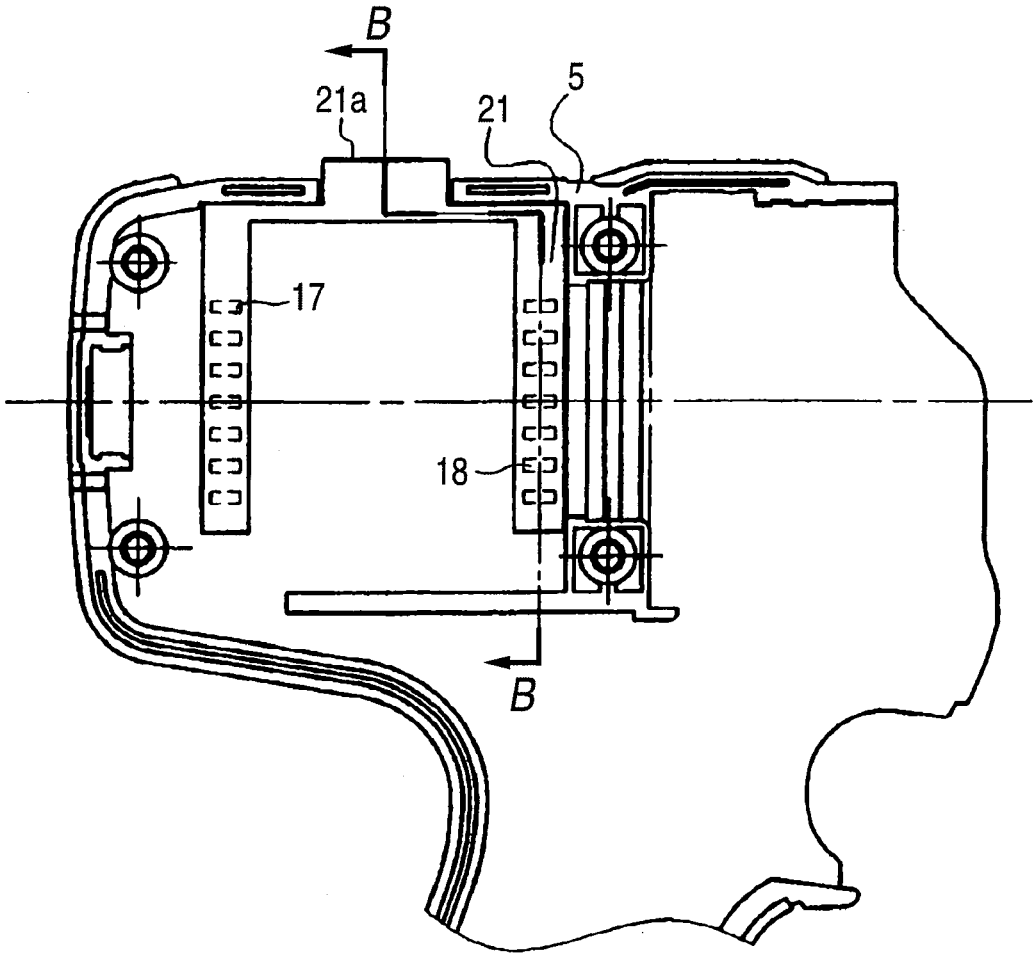
FIG. 5 is a fragmentary internal view of a housing of an impact driver according to a second embodiment.
Figure 6:
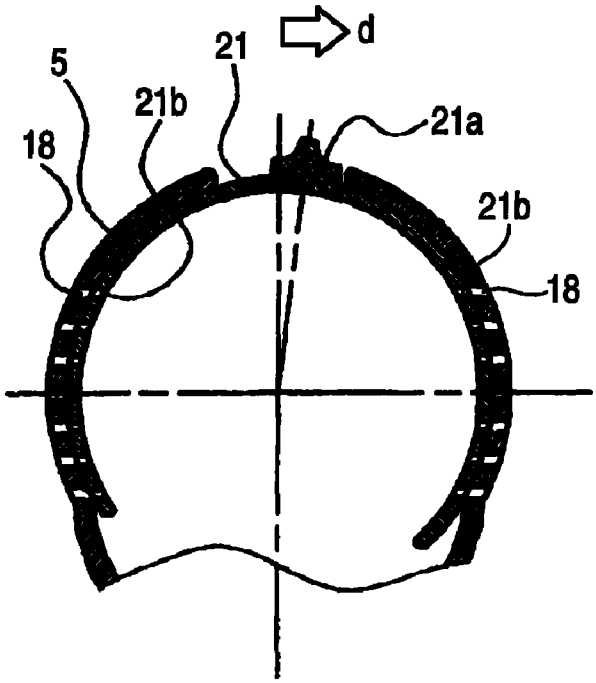
FIG. 6 is a cross-sectional view taken along line B-B shown in FIG. 5, showing a state where both the air inlets and the air outlets are opened.
Figure 7:
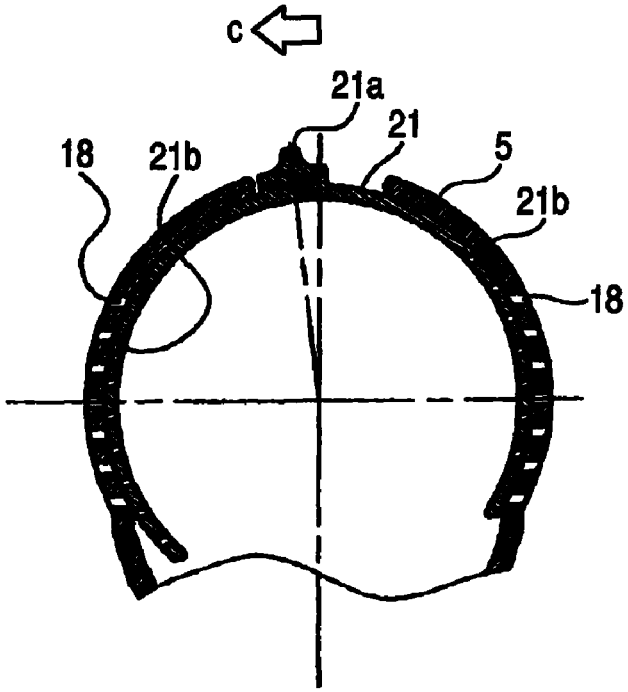
FIG. 7 is a cross-sectional view taken along line B-B shown in FIG. 5, showing a state that both the air inlets and the air outlets are closed.

FIG. 5 is a fragmentary internal view of a housing of an impact driver according to a second embodiment; and FIGS. 6 and 7 are cross-sectional views taken along line B-B shown in FIG. 5, wherein FIG. 6 shows a state where both the air inlets and the air outlets are opened and FIG. 7 shows a state that both the air inlets and the air outlets are closed.

The present embodiment is characterized in that a cover 21 is rotated in a circumferential direction along the inside of the housing 5, thereby simultaneously opening and closing the air inlets 17 and the air outlets 18. Air vents 21*b* (only air vents in mutual communication with the air outlets 18 are shown in FIGS. 6 and 7) that are selectively brought into mutual communication with the air inlets 17 and the air outlets 18 formed in the housing 5 are provided in the cover 21. A lever 21*a* for rotationally operating the cover 21 is formed integrally in a part of an upper surface of the cover 21 exposed through the housing 5.

In the present embodiment, in a working environment with much extraneous matter, such as dust or metal powder, the lever 21*a* is operated to rotate the cover 21 in the direction of arrow "c" shown in FIG. 7 along the inside of the housing 5 (in a counterclockwise direction) thereby simultaneously closing the air inlets 17 and the air outlets 18 by means of the cover 21 as shown in FIG. 7. As a result, intrusion of extraneous matter, such as dust, into the housing 5 is thoroughly hindered, thereby preventing occurrence of various problems attributable to intrusion of extraneous matter, such as a failure.

In contrast, during work performed in a comparatively-clean environment with little extraneous matter, the lever 21*a* is operated to rotate the cover 21 in the direction of arrow "d" (a clockwise direction) of FIG. 6 along the inside of the housing 5, thereby bringing the air vents 21*b* of the cover 21 (only one of the air vents is shown in FIG. 6) into mutual communication with the air inlets 17 and the air outlets 18 as shown in FIG. 6 and opening both the air inlets 17 and the air outlets 18. Cooling air is actively introduced into the housing 5 by way of the air inlets 17, and the electric motor 3 is efficiently cooled by the cooling air. Thus, an increase in the temperature of the electric motor is prevented.

Therefore, even in the present embodiment, an air intake and exhaust state of the cooling air suitable for a working environment can be selected.

Third Embodiment

A third embodiment will be described by reference to FIGS. 8 and 9.

Figure 8:
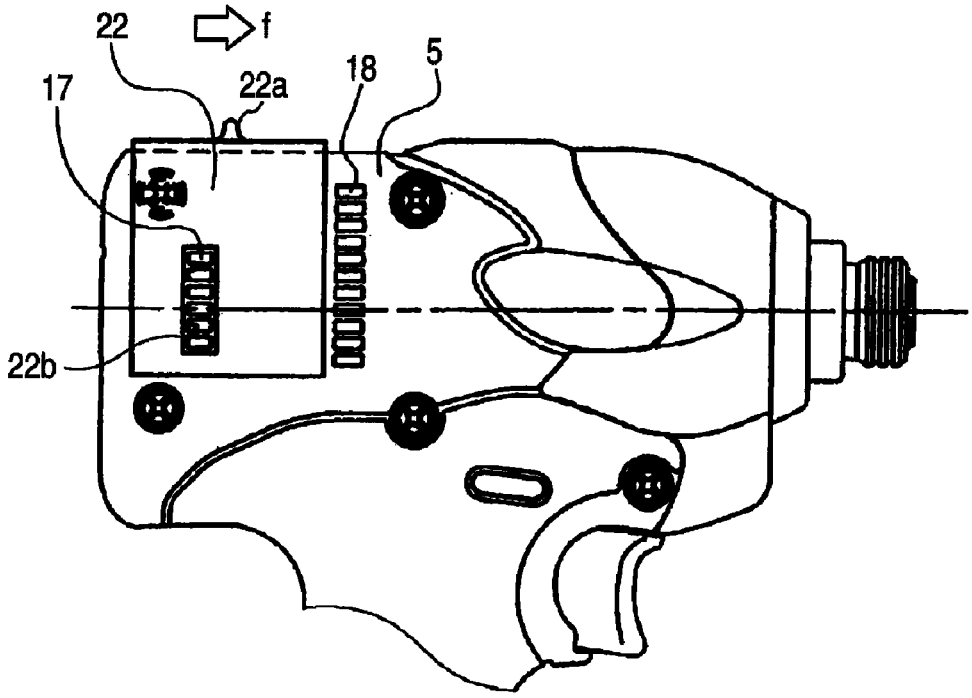
FIG. 8 is a fragmentary side view showing a state where air inlets and air outlets provided in an impact driver according to a third embodiment are opened.
Figure 9:
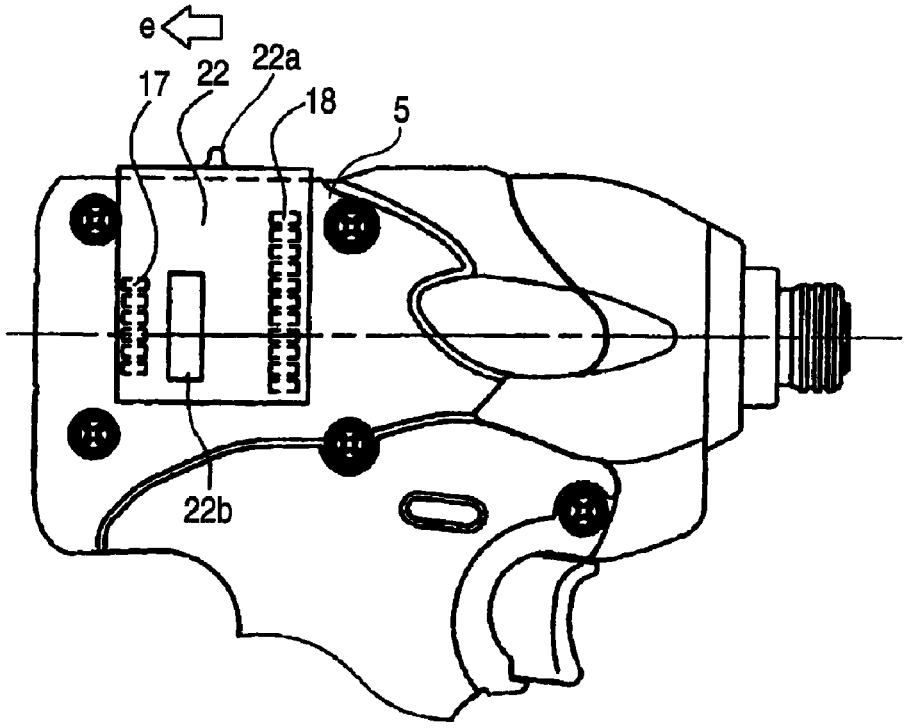
FIG. 9 is a fragmentary side view showing a state where air inlets and air outlets provided in an impact driver according to the third embodiment are closed.

FIGS. 8 and 9 are fragmentary side views of an impact driver according to a third embodiment, wherein FIG. 8 shows a state where both the air inlets and the air outlets are opened and FIG. 9 shows a state that both the air inlets and the air outlets are closed.

The present embodiment is characterized in that a cover 22 is slid in a longitudinal direction along the outside of the housing 5, thereby simultaneously opening and closing the air inlets 17 and the air outlets 18. Rectangular air vents 22*b* (only one of the air vents is shown in FIGS. 8 and 9) that are selectively brought into mutual communication with the air inlets 17 formed in the housing 5 are provided at both ends of the cover 22. A lever 22*a* for sliding the cover 22 is formed integrally in a part of an upper surface of the cover 22.

In the present embodiment, in a working environment with much extraneous matter, such as dust or metal powder, the lever 22*a* is operated to slide the cover 22 in a direction of arrow "e" shown in FIG. 9 along the outside of the housing 5 (a forward direction), thereby simultaneously closing the air inlets 17 and the air outlets 18 by means of the cover 22 as shown in FIG. 9. As a result, intrusion of extraneous matter, such as dust, into the housing 5 is thoroughly hindered, thereby preventing occurrence of various problems attributable to intrusion of extraneous matter, such as a failure.

In contrast, during work performed in a comparatively-clean environment with little extraneous matter, the lever 22*a* is operated to slide the cover 22 in the direction of arrow "f" (a backward direction) of FIG. 8 along the outside of the housing 5, thereby bringing the air vents 22*b* of the cover 22 into mutual communication with the air inlets 17 as shown in FIG. 8 and opening the air outlets 18. As a result, both the air inlets 17 and the air outlets 18 are opened, and cooling air is actively introduced into the housing 5 by way of the air inlets 17, so that the electric motor 3 is efficiently cooled by the cooling air. Thus, an increase in the temperature of the electric motor is prevented.

Therefore, even in the present, an air intake and exhaust state of the cooling air suitable for a working environment can be selected.

Fourth Embodiment

A fourth embodiment will now be described by reference to FIGS. 10 and 11.

Figure 10:
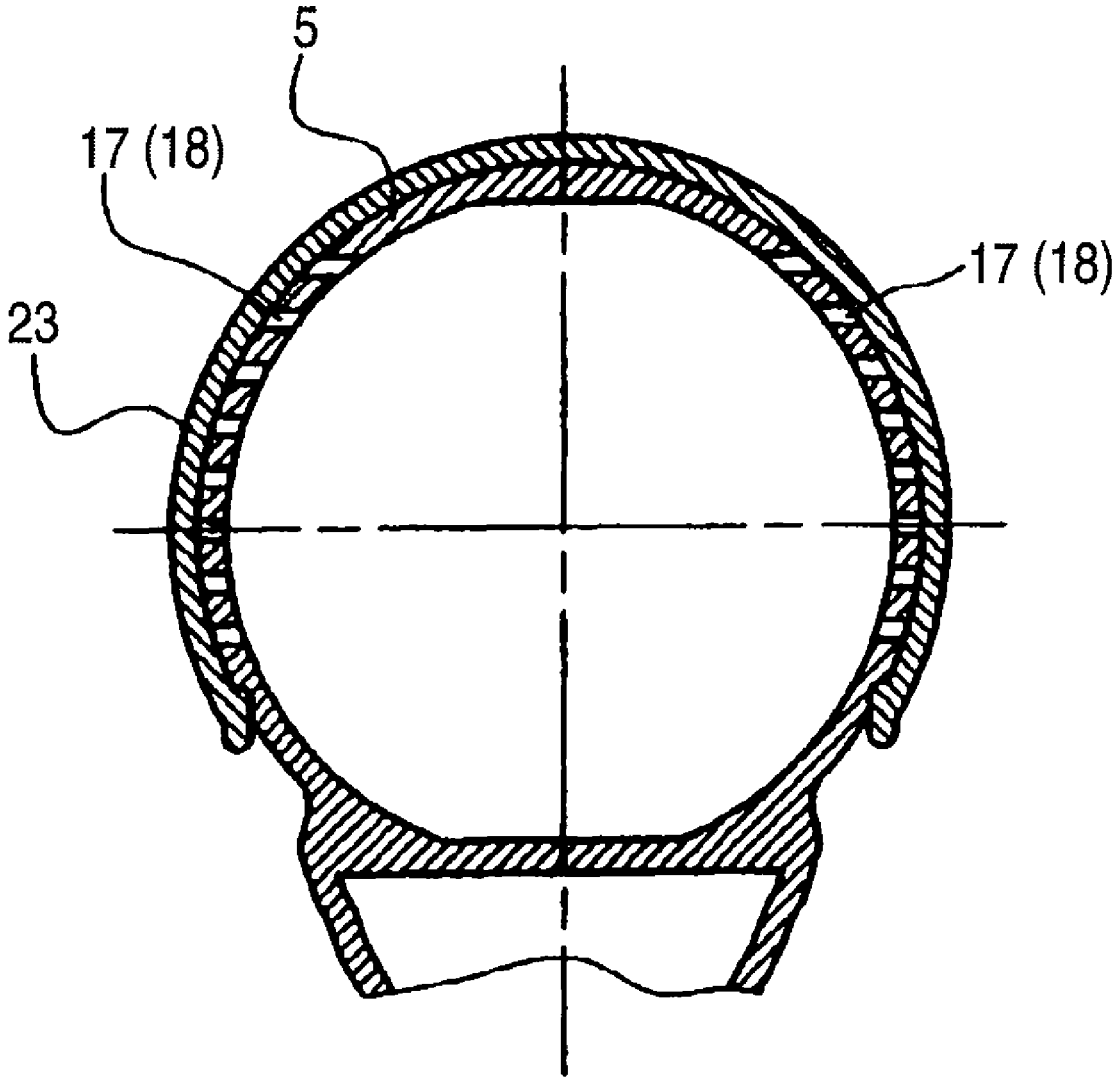
FIG. 10 is a fragmentary transverse-sectional view of a housing, showing a state where a cover is attached to the impact driver according to the third embodiment.
Figure 11:
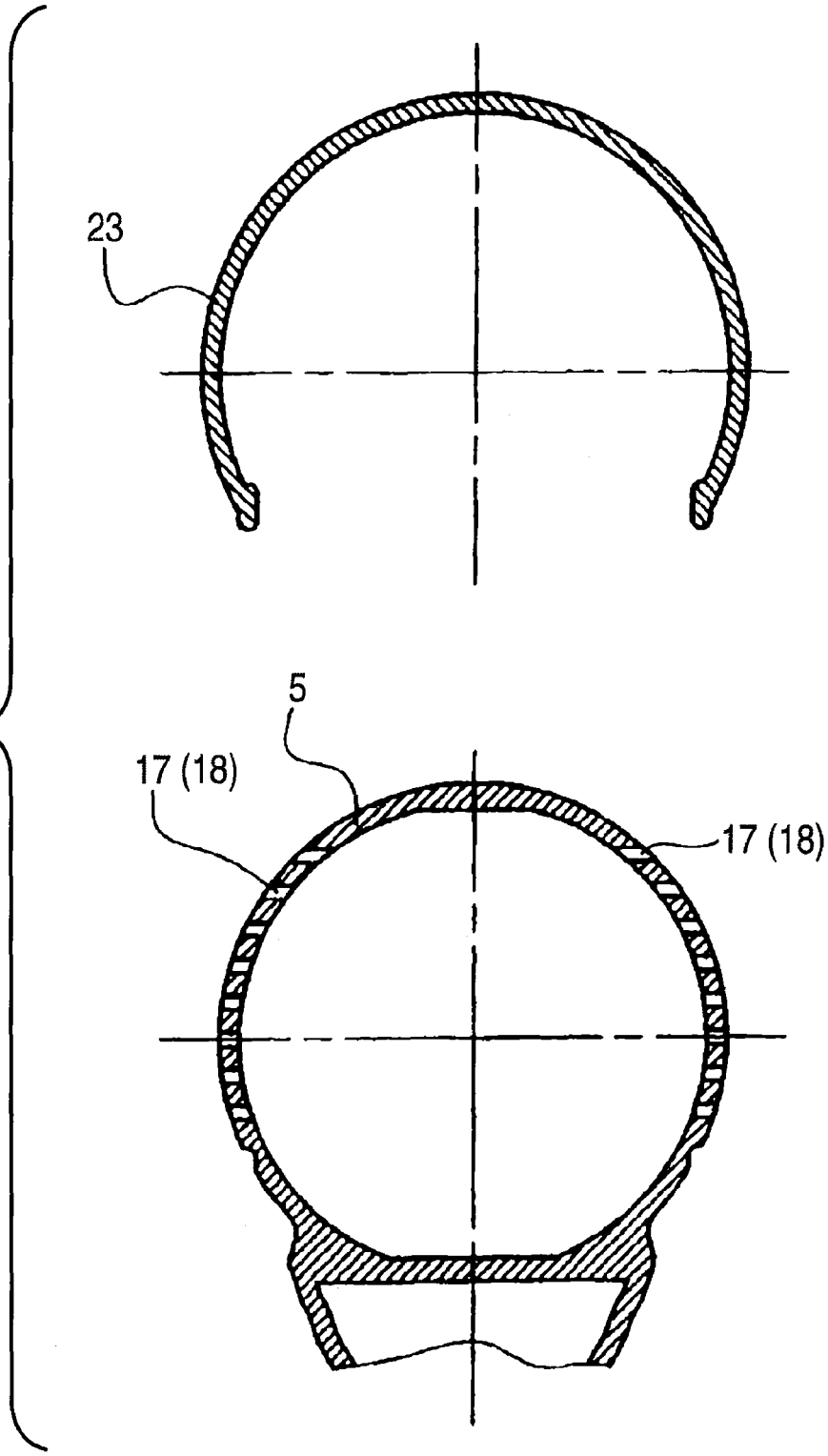
FIG. 11 is a fragmentary transverse-sectional view of a housing, showing a state where a cover is removed from the impact driver according to the third embodiment.
Figure 12:
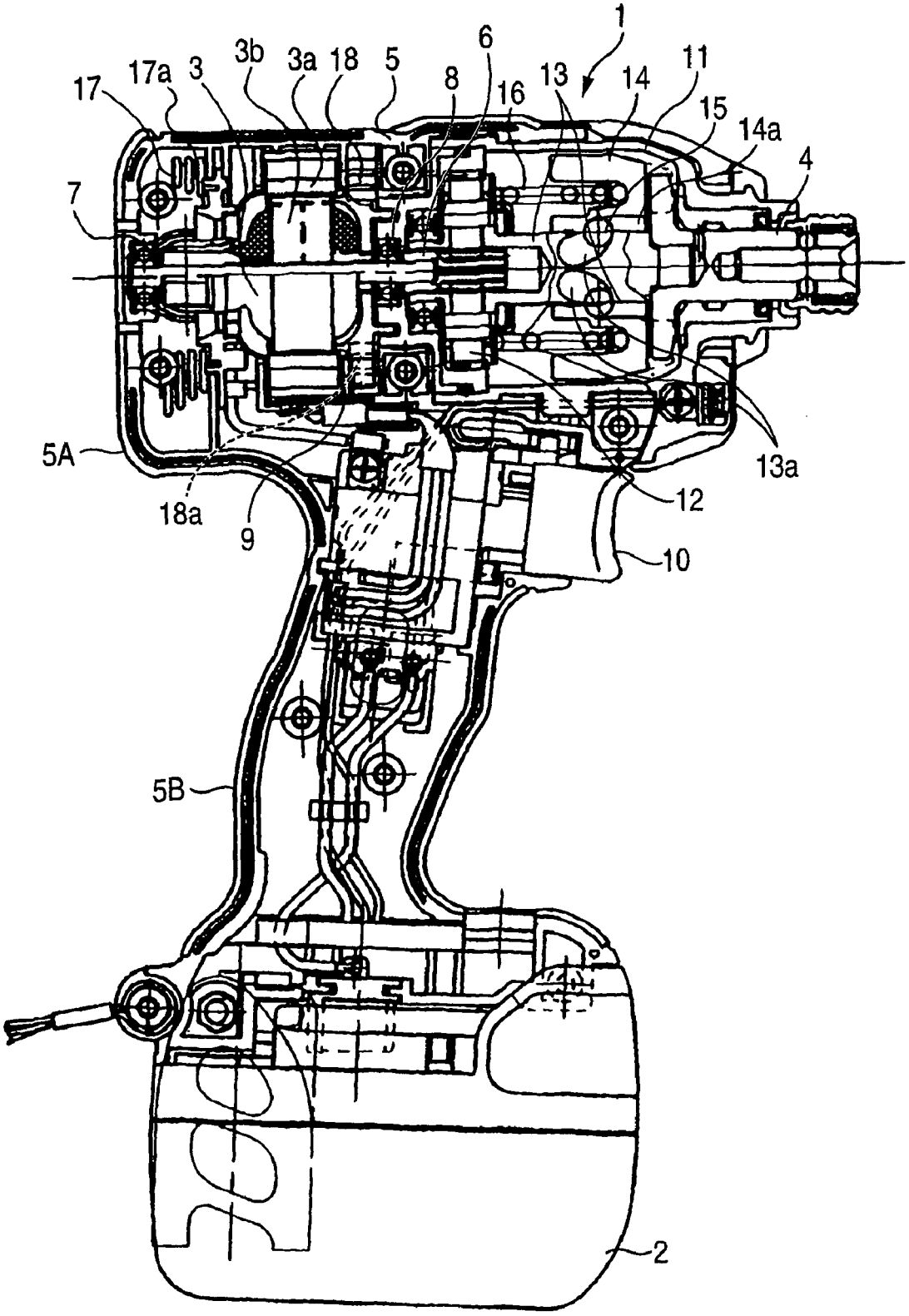
FIG. 12 PRIOR ART
FIG. 12 is a side cross-sectional view of a related-art impact driver.

FIG. 10 is a fragmentary transverse-sectional view of a housing in a state where a cover is attached to an impact driver according to the fourth embodiment, and FIG. 11 is a fragmentary transverse-sectional view of a housing in a state where the cover is removed from the impact driver.

The present embodiment is characterized in that a cylindrical cutout cover 23 that simultaneously opens and closes the air inlets 17 and the air outlets 18 formed in the housing 5 is removably attached to the housing 5.

In the present embodiment, in a working environment with much extraneous matter, such as dust or metal powder, the cover 23 is attached to the housing 5 as shown in FIG. 10, thereby simultaneously closing the air inlets 17 and the air outlets 18 by means of the cover 23. As a result, intrusion of extraneous matter, such as dust, into the housing 5 is prevented thoroughly, whereby occurrence of various problems attributable to intrusion of extraneous matter, such as a failure, is prevented.

In contrast, during work performed in a comparatively-clean environment with little extraneous matter, the cover 23 is removed from the housing 5 as shown in FIG. 11, thereby opening both the air inlets 17 and the air outlets 18. Thus, cooling air is actively introduced into the housing 5, thereby efficiently cooling the electric motor 3 by means of cooling air and preventing an increase in the temperature of the electric motor 3.

Accordingly, even in the present embodiment, an air intake and exhaust state of the cooling air suitable for a working environment can be selected.

In particular, in the present embodiment, the cover 23 is formed from a soft material, such as soft rubber, whereby the cover 23 can be caused to act as a protector and infliction of flaws on a material to be machined can be prevented. Further, so long as several types of colors and patterns of the cover 23 are prepared in advance, the covers 23 to be attached to the respective impact drivers 1 used by individual operators can be readily discerned.

Although the embodiments where the present invention is applied particularly to the impact drill have been described thus far, similar advantages can also be yielded by applying, in an analogous manner, the present invention to another arbitrary electric tool having air inlets and air outlets that are formed in a housing and that supply and discharge cooling air for cooling an electric motor.

What is claimed is:

1. An electric tool comprising:

a body housing;

a motor with a cooling fan that is housed in the body housing, the motor having an output shaft that defines an axial direction;

a tip tool;

a rotational transmission mechanism disposed in the body housing to transmit a rotational force of the output shaft of the motor to the tip tool;

an air inlet formed on a peripheral surface of the body housing to introduce a cooling air into the body housing for cooling the motor;

an air outlet formed on the peripheral surface of the body housing to discharge the cooling air to an outside of the body housing; and a cover member disposed on an inner wall or an outer wall of the body housing to cover the air inlet and the air outlet, the cover member being slidable in the axial direction between a first position where the air inlet and the air outlet are both opened and a second position where the air inlet and the air outlet are both closed, wherein an elastic member is interposed between the cover member and a surface of the body housing.

2. An electric tool comprising:

a body housing;

a motor with a cooling fan that is housed in the body housing, the motor having an output shaft that defines an axial direction;

a tip tool;

a rotational transmission mechanism disposed in the body housing to transmit a rotational force of the output shaft of the motor to the tip tool;

an air inlet formed on a peripheral surface of the body housing to introduce a cooling air into the body housing for cooling the motor;

an air outlet formed on the peripheral surface of the body housing to discharge the cooling air to an outside of the body housing; and a cover member disposed on an inner wall or an outer wall of the body housing to cover the air inlet and the air outlet, the cover member being slidable in the axial direction between a first position where the air inlet and the air outlet are both opened and a second position where the air inlet and the air outlet are both closed, wherein the body housing is formed with an opening extending in the axial direction, and wherein a lever is integrally formed with the cover member and protruding through the opening to the outside of the body housing, the lever being operated to move the cover member between the first position and the second position.

3. An electric tool comprising:

a body housing;

a motor with a cooling fan that is housed in the body housing, the motor having an output shaft that defines an axial direction;

a tip tool;

a rotational transmission mechanism disposed in the body housing to transmit a rotational force of the output shaft of the motor to the tip tool;

an air inlet formed on a peripheral surface of the body housing to introduce a cooling air into the body housing for cooling the motor;

an air outlet formed on the peripheral surface of the body housing to discharge the cooling air to an outside of the body housing; and a cover member disposed on an inner wall or an outer wall of the body housing to cover the air inlet and the air outlet, the cover member being rotationally slidable in a direction perpendicular to the axial direction between a first position where the air inlet and the air outlet are both opened and a second position where the air inlet and the air outlet are both closed, wherein the body housing is formed with an opening extending in a circumferential direction of the body housing, and wherein a lever is integrally formed with the cover member and protruding through the opening to the outside of the body housing, the lever being operated to rotate the cover member between the first position and the second position.

* * * * *